US008882491B2

(12) United States Patent
Rütten

(10) Patent No.: US 8,882,491 B2
(45) Date of Patent: Nov. 11, 2014

(54) CONNECTION DUCT

(75) Inventor: Thomas Rütten, Wegberg (DE)

(73) Assignee: Dome Holding GmbH, Dauchingen (DE)

( * ) Notice: Subject to any disclaimer, the term of this patent is extended or adjusted under 35 U.S.C. 154(b) by 1116 days.

(21) Appl. No.: 12/850,161

(22) Filed: Aug. 4, 2010

(65) Prior Publication Data

US 2011/0033809 A1 Feb. 10, 2011

(30) Foreign Application Priority Data

Aug. 7, 2009 (DE) ..... 20 2009 010 689 U

(51) Int. Cl.

| | |
|---|---|
| ***F23M 3/00*** | (2006.01) |
| ***F23D 14/36*** | (2006.01) |
| ***F23C 7/00*** | (2006.01) |
| ***F23D 11/00*** | (2006.01) |
| ***F23L 5/02*** | (2006.01) |

(52) U.S. Cl.

CPC ..... *F23D 14/36* (2013.01); *F23C 7/002* (2013.01); *F23D 11/001* (2013.01); *F23L 5/02* (2013.01)

USPC ..... 431/9; 431/12; 431/185; 431/353; 239/399; 239/402.5

(58) Field of Classification Search

USPC ..... 431/9, 185, 12, 353; 239/399, 402.5

See application file for complete search history.

(56) References Cited

U.S. PATENT DOCUMENTS 2,205,456 A * 6/1940 Andler et al. ..... 415/211.2
2,214,246 A * 9/1940 Finnigan ..... 239/402.5
2,231,884 A * 2/1941 Carter ..... 431/265
2,262,525 A * 11/1941 De Lancey ..... 239/402.5
2,301,060 A * 11/1942 Livar ..... 431/153

(Continued)

FOREIGN PATENT DOCUMENTS

DE 30 11 287 10/1981
DE 39 36 105 A1 5/1991

(Continued)

OTHER PUBLICATIONS

German Patent Appln. Serial No. 10008031.6 EPC Search Report dated Sep. 14, 2012, 4 pages in German, English translation—4 pages.

(Continued)

*Primary Examiner* — Jorge Pereiro

(74) *Attorney, Agent, or Firm* — Andrew F. Young, Esq.; Lackenbach Siegel, LLP

(57) ABSTRACT

The invention is a connection duct between the blower and a mixing device of a burner. The connection duct expands wedge-shaped along a first direction and diverts air from the blower to a second direction. The connection duct further comprises diverting means for diverting the air in a circular flow around the second direction corresponding to a longitudinal axis of the mixing device. The diverting means comprise a tube section with at least one inflow opening arranged in the peripheral wall of the diverting means. A truncated cone comprising a tapering section is arranged in the tube section so that the tapering section faces in the direction of the mixing device. A passage cross-section of the inflow opening can be adjusted by a tube arranged in the peripheral wall which can be rotated around the tube's longitudinal axis and bears against the internal surface of the tube section.

5 Claims, 14 Drawing Sheets

(56) References Cited

U.S. PATENT DOCUMENTS

| | | | | | |
|---|---|---|---|---|---|
| 2,390,509 | A | * | 12/1945 | Carter | 431/114 |
| 2,405,196 | A | * | 8/1946 | Elliot et al. | 239/406 |
| 2,456,930 | A | * | 12/1948 | De Lancey | 415/214.1 |
| 2,465,675 | A | * | 3/1949 | De Lancey | 431/69 |
| 2,485,206 | A | * | 10/1949 | Logan | 431/62 |
| 2,599,153 | A | * | 6/1952 | Beckett | 431/188 |
| 2,634,806 | A | * | 4/1953 | Hirtz | 239/125 |
| 2,721,704 | A | * | 10/1955 | Patrick | 236/10 |
| 2,818,109 | A | * | 12/1957 | Voorheis | 431/184 |
| 4,500,282 | A | * | 2/1985 | Eschenko et al. | 431/184 |
| 5,460,514 | A | * | 10/1995 | Toyoshima et al. | 431/183 |
| 6,019,593 | A | * | 2/2000 | Lewandowski et al. | 431/12 |

FOREIGN PATENT DOCUMENTS

| | | |
|---|---|---|
| DE | G 94 04 776.6 | 9/1994 |
| DE | 298 03 416 | 6/1998 |
| DE | 298 03 416 U1 | 6/1998 |
| EP | DE9404776 | 7/1994 |
| EP | 0 797 047 | 9/1997 |
| FR | 2492054 | 10/1980 |

OTHER PUBLICATIONS

German Patent Appln. Serial No. 20 2009 010 689.6 Search Report dated Jun. 22, 2011, 3 pages in German, English translation—3 pages.

EP Patent Appln. Serial No. 10008031.6 issued Jan. 24, 2014, 5 pages in German, English translation—2 pages.

* cited by examiner

CONNECTION DUCT

CROSS REFERENCE TO RELATED APPLICATIONS

This application claims priority from German Patent Application Serial No. 20 2009 010 689.6, filed Aug. 7, 2009, the entire contents of which is herein incorporated fully by reference.

FIGURE FOR PUBLICATION

To be determined by the U.S.P.T.O.

BACKGROUND OF THE INVENTION

1. Field of the Invention

The present invention relates to a connection duct between a blower of a burner and a mixing device of that burner. More specifically, the present invention relates to a connection duct between a blower and a burner and a mixing device of the burner such that a favorable influx of air into the mixing device is accomplished so that the air is swirled already before it enters the air nozzle in order to achieve an optimal airflow for attaining a stable flame.

2. Description of the Related Art

The related art involves burners with a blower and a mixing device; and, wherein the blower creates an airflow in a first direction and the air is introduced into the mixing device. For this purpose, connection ducts between the blower of a burner and a mixing device of a burner are known, by which the air created by the blower is introduced into the mixing device. It is known, that the blower is introduced into the extension of the longitudinal axis of the mixing device.

One difficulty that arises is that the blower is subjected to a high thermal load by the combustion chamber. Therefore, it is also known to arrange the blower such that the air flows out in a first direction, and to divert the air in a connection duct in a second direction, so that the blower can be offset laterally in relation to the longitudinal axis of the mixing device, where the thermal load is less for the blower.

What is not appreciated by the prior art is that the air flow is not optimized when introduced to the mixing chamber of the burner. Accordingly, there is a need for an improved connection duct between a blower and a burner and a mixing device of a burner such that a favorable influx of air into the mixing device is accomplished.

The invention teaches that this aspect is achieved through a connection duct between a blower of a burner and a mixing device of a burner, for diverting outflowing air from the blower from a first direction to a second direction, and wherein the connection duct further comprises diverting means for diverting the air in a circular flow around the second direction.

ASPECTS AND SUMMARY OF THE INVENTION

An aspect of the present invention is to provide a connection duct between a blower of a burner and a mixing device of a burner, for diverting outflowing air from the blower from a first direction to a second direction.

Another aspect of the present invention is to provide diverting means for diverting the air in a circular flow around the second direction such that a favorable influx of air into the mixing device is accomplished.

The connection duct, as taught by the invention, between the blower of a burner and the mixing device of the burner which diverts the air flowing out of the blower in a first direction into a second direction, which in particular is perpendicular in relation to the first direction, is characterized in that means are provided in the connection duct which direct the air in a circular flow around the second direction. In this manner, the air is swirled already before it enters the air nozzle in order to achieve an optimal airflow for attaining a stable flame.

A preferred embodiment is that the second direction corresponds to a longitudinal axis of a mixing device, so that the air is introduced by the connection duct into the mixing device in the desired direction.

The connection duct preferably expands wedge-shaped along the first direction in order to further aid the influx of air into the burner tube in the direction towards the air nozzle and to increase the static combustion air pressure.

Another aspect incorporates the means for directing the air in a circular flow around the second direction as a tube section with at least one inflow opening arranged in the peripheral wall and developed in a longitudinal axis, wherein the longitudinal axis runs parallel to the second direction and the air from the first direction flows into the tube section from the first direction tangentially through the inflow opening. With a tangential inflow, the desired circular flow results on the inside wall of the tube section.

A further aspect is a passage cross-section of the inflow opening that is variable, so that the air volume and the air velocity can be changed.

A further aspect is a tube with an opening arranged in the peripheral wall for varying the passage cross-section of the inflow opening which is arranged so that it can be rotated around its longitudinal axis and which particularly bears against one external surface at least in sections of the internal surface of the tube section. In this manner, space-saving means for varying the passage cross-section are provided.

According to a preferred embodiment of the invention, the tube has a tangentially arranged deflector, which favors splitting-up the airflow.

An embodiment of the means for directing the air into a circular flow around the second direction is that the means are developed as a tube section with two diametrically opposed inflow openings arranged in the peripheral wall and a longitudinal axis, wherein the longitudinal axis runs parallel to the second direction and the air from the first direction flows tangentially into the tube section through the inflow openings, where between the blower and the tube section an air deflector is arranged approximately parallel to the first direction such that a part of the inflowing air flows in through one of the inflow openings and a part of the inflowing air is diverted by means of the air deflector and flows into the tube section through the diametrically opposed inflow opening. Consequently, air flows tangentially through two diametrically opposed inflow openings into the tube section, which improves the homogenous swirling.

The air deflector is preferably arranged so that it can be varied within the connection duct, so that the air volume of the inflow openings can be variably distributed. An increase of the angular momentum of the air column can be achieved by a helicoidal extension of the external radial air duct.

Preferably, a truncated cone is arranged in the tube section, the tapered section of which faces into the direction of the mixing device, in order to facilitate an airflow in the direction of the mixing device that is as non-turbulent as possible.

The mixing device preferably comprises a burner tube, where the tube section at the same time forms the burner tube of the mixing device, so that the swirled air flows directly into the burner tube in this manner.

A burner as taught by the invention comprises a blower, a mixing device, and a connection duct as taught by the invention.

In a further embodiment of the present invention, the burner comprises a blower, where the blower speed is steplessly variable, in order to vary the air volume required for the combustion, the air velocity, and the air pressure, especially in combination with a fuel nozzle that can be axially shifted toward the air nozzle arranged on the nozzle connection of the mixing device.

In a further embodiment of the present invention, the mixing device comprises a nozzle connection with a nozzle by means of which the fuel is supplied, where the fuel quantity is steplessly variable, for example with the help of an appropriate fuel pump or an appropriate fuel valve. The burner can also be operated in a modulating operating mode, particularly in combination with the variable speed-controlled blower and the axially shiftable nozzle connection, in addition to a single or multistage operation of the burner.

The above, and other aspects, features and advantages of the present invention will become apparent from the following description read in conjunction with the accompanying drawings, in which like reference numerals designate the same elements.

DETAILED DESCRIPTION OF THE PREFERRED EMBODIMENTS

Figure 1:
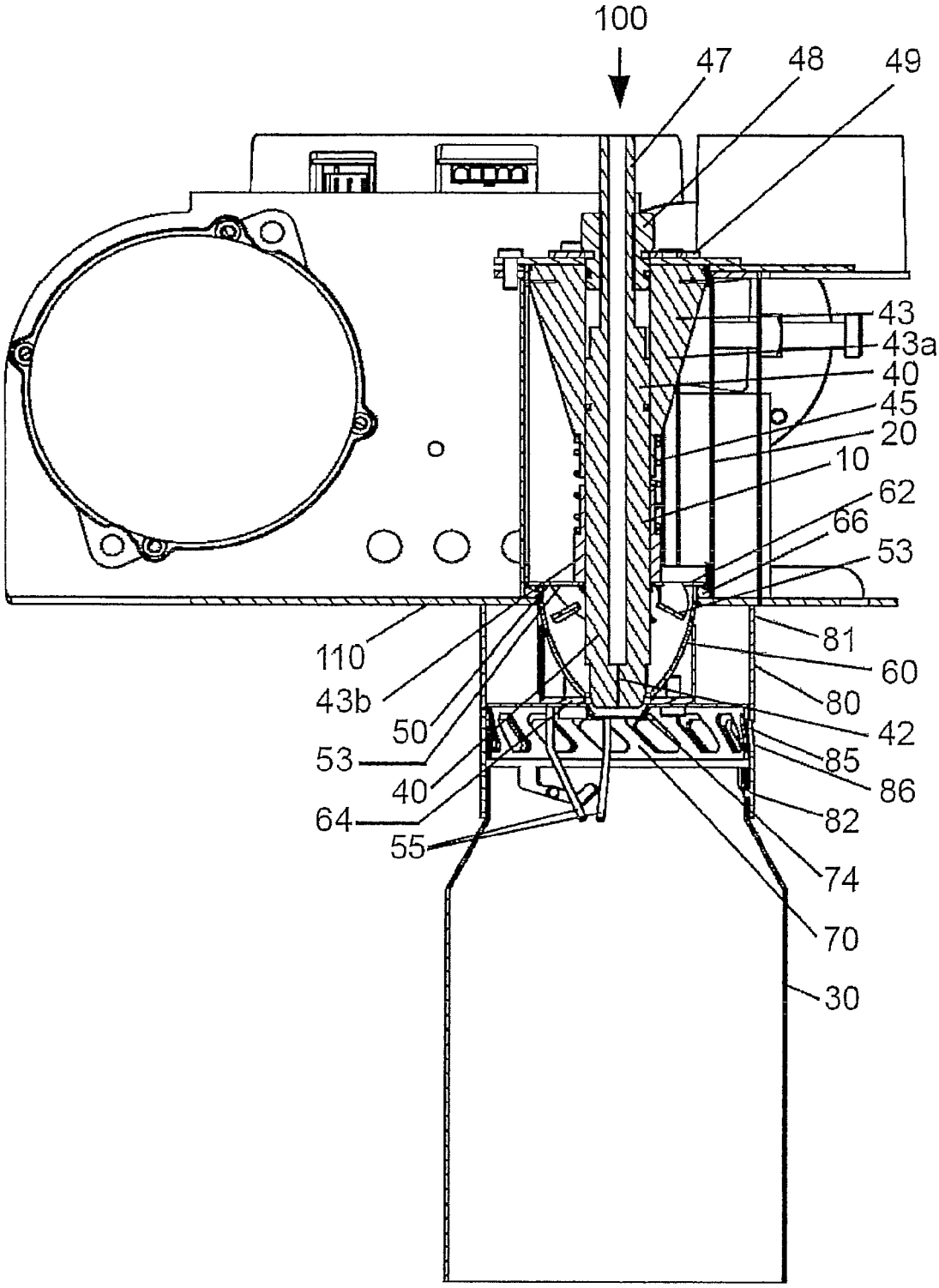
FIG. 1 is a cutaway view of a part of a burner with a mixing device according to a first embodiment of the invention.

Reference will now be made in detail to several embodiments of the invention that are illustrated in the accompanying drawings. Wherever possible, same or similar reference numerals are used in the drawings and the description to refer to the same or like parts or steps. The drawings are in simplified form and are not to precise scale. For purposes of convenience and clarity only, directional terms, such as top, bottom, up, down, over, above, and below may be used with respect to the drawings. These and similar directional terms should not be construed to limit the scope of the invention in any manner. The words "connect," "couple," and similar terms with their inflectional morphemes do not necessarily denote direct and immediate connections, but also include connections through mediate elements or devices.

Figure 2:
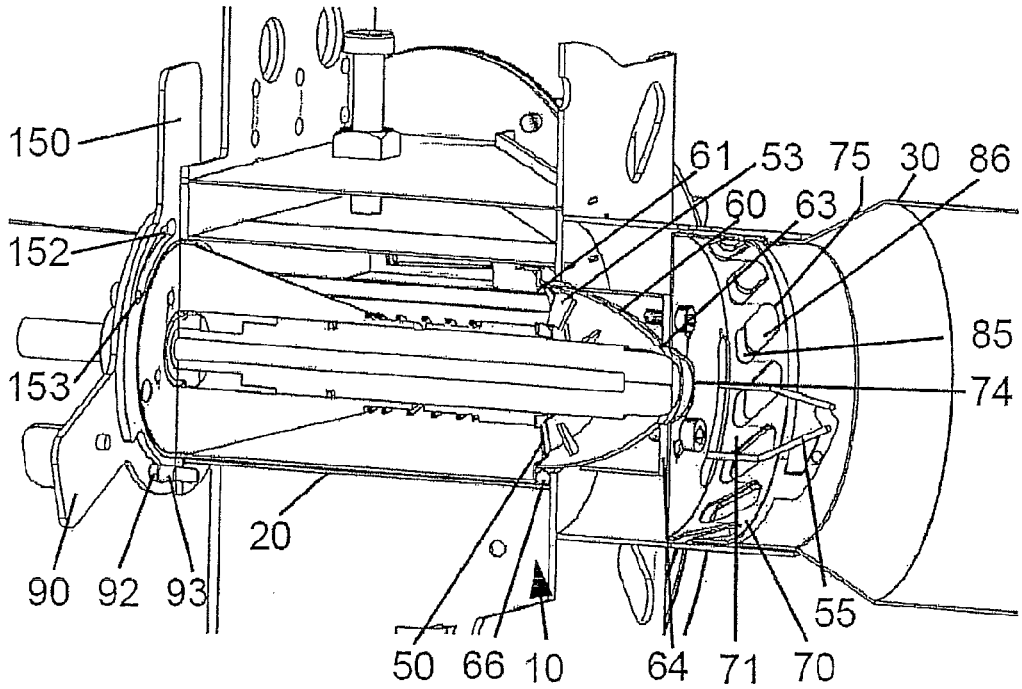
FIG. 2 is a partial section of a perspective view of the mixing device according to FIG. 1 with recirculation means shown in a first position.
Figure 3:
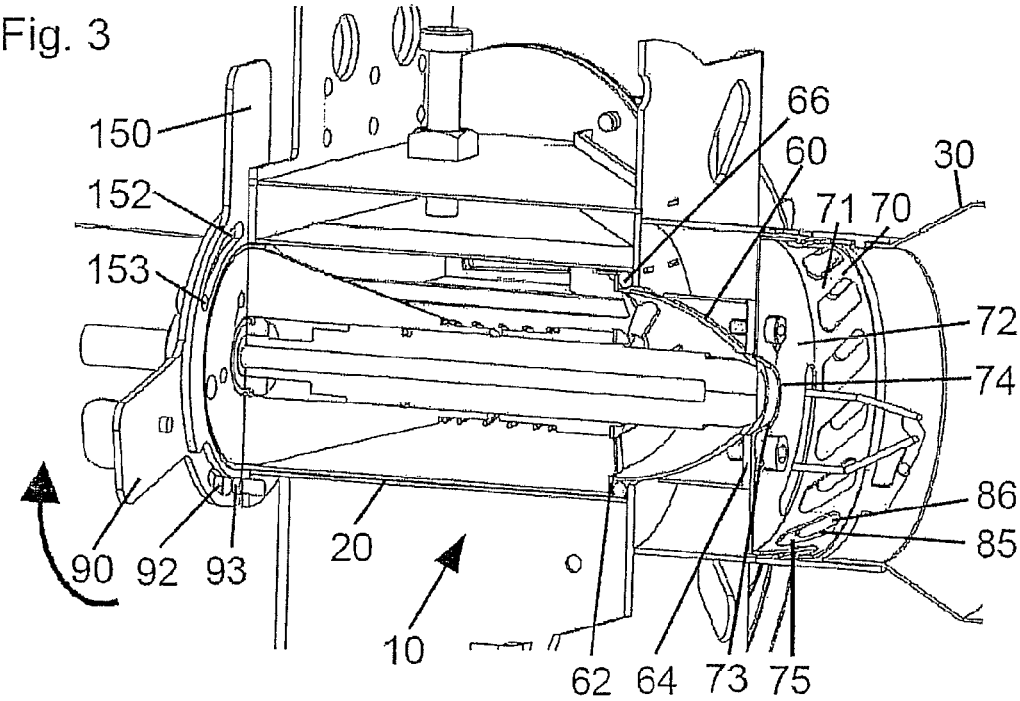
FIG. 3 is the mixing device according to FIG. 2 with the recirculation means shown in a second position.

FIGS. 1 to 3 show different views of a mixing device 10, which comprises a burner tube 20, which is supplied with combustion air from a blower 120. A flame-tube 30 connects axially to the burner tube 20. In principle, it is possible that the flame-tube 30 attaches directly to the burner tube 20 and is thus shaped partially overlapping, wherein every conceivable connection between the burner tube 20 and the flame-tube 30 is possible. In the present embodiment, the burner tube 20 terminates on one interior side of a casing 110 of a burner 100, wherein the flame-tube 30 is attached outside of the casing 110 of the burner 100 with the help of an adapter ring 80. The flame-tube 30 has an expanded diameter compared to the burner tube 20. It is also possible, however, that the diameter of the flame-tube tapers compared to the burner tube 20 or that the burner to 20 and the flame-tube 30 have essentially identical diameters. The mixing device 10 comprises a longitudinal axis 1. The longitudinal axis 1 of the mixing device essentially corresponds to the longitudinal axis of the burner tube 20 and the longitudinal axis of the flame-tube 30.

Between the burner tube 20 and the flame-tube 30, a junction region is formed which in an overlapping arrangement of the burner tube 20 and the flame-tube 30 comprises the end sections of the burner tube 20 and/or the flame-tube 30 that are facing each other and can as presently include the adapter ring 80, if an adapter ring 80 is used.

The adapter ring 80 comprises an end section 81 facing the burner tube 20 and an end section 82 facing the flame-tube 30, wherein the adapter ring 80 with its end section 81 is attached to the outside of the casing 110 and in its end section 82 comprises an overlap with the flame-tube 30 and is connected with the flame-tube 30 by means of a quarter-turn fastener. Alternatively, a connection can also be made by press-fit or by welding.

In the junction region of burner tube 20 and flame-tube 30, recirculation openings 85 are arranged, which, depending on the connection between the burner tube 20 and the flame-tube 30, can be arranged in an end section of the burner tube 20 facing the flame-tube 30, in an end section of the flame-tube 30 facing the burner tube and/or in the adapter ring 80, wherein they are arranged in the adapter ring 80 in the present case. Combustion gases from the combustion chamber can be recycled through the recirculation openings 85 into the flame of the mixing device 10.

A separation disk 50 is inserted into the burner tube 20, the outside diameter of which essentially corresponds to the inside diameter of the burner tube 20 and which comprises a centric opening 51, through which a nozzle connection 40 with a fuel nozzle 42 is run coaxially. An air nozzle 60 is arranged coaxially on the separation disk 50, which is developed so that it comprises an inlet opening 61 that is facing the burner tube 20 and which tapers from the diameter of the inlet opening 61 up to the discharge opening 63 which is facing the flame tube 30. The air nozzle 60 comprises a flange 64 on its opening 61, which in the present example is formed by the separation disk 50. The air nozzle 60 essentially has a conical shape, which can also comprise an arched outer casing or an outer casing like a truncated cone. It is also possible that the air nozzle 60 initially has a cylindrical section which connects to a tapering section.

The casing 110 of the burner 100 comprises an opening 112 through which the air nozzle 60 projects, wherein the air nozzle 60 seals the casing 110 of the burner 100 on the combustion air side by means of the flange 62, i.e. by means of the separation disk 50. For that purpose, a seal 66 is arranged between the flange 62 and the inside wall of the casing 110, wherein the flange 62 comprises an outside diameter that is larger than that diameter of the opening 112 of the casing 110 and the air nozzle 60 on the end of the burner tube that has an outside diameter which essentially corresponds to the diameter of the opening 112. The flange 62 and the seal 66 are pressed from the inside against the inside wall of the casing 110, for example by spring loading.

The separation disk 50 comprises swirl openings 53 which puts the air that flows through the burner tube 20 into the air nozzle 60 in rotation around the longitudinal axis 1 of the mixing device 10.

A nozzle connection 40 is axially inserted in the air nozzle 60, by means of which the fuel, for example, is supplied both in a gaseous form as well as in a liquid form. At the front end of the nozzle connection 40, the fuel is discharged atomized through the fuel nozzle 42. The supplied gaseous or liquid fuels can be fossil, synthetic, or biogenic fuels.

The fuel nozzle 42 can be developed as a fuel nozzle for liquid fuels, or as a gas nozzle. It is also possible that the nozzle connection 40 is developed with an annular gas nozzle in the area of the fuel nozzle 42 for liquid fuels, for oil for example, so that the burner 100 can be operated as a dual-fuel operation with gas and liquid fuel.

The mixing device 10 comprises two ignition electrodes 55 of a transistorized ignition system with which the atomized fuel is ignited. The ignition electrodes 50 are angled on their free ends such that their free ends are positioned at a smaller distance than their ends that are not angled, where the free ends are essentially bent in front of the discharge openings 63 of the air nozzle 60. The flame is ignited between both ends of the ignition electrodes 55. The fuel nozzle 42 is arranged in this instance such that the flame in the flame-tube 30 extends in front of the discharge opening 63 of the air nozzle 60. The externally attached ignition electrodes 55 can be replaced without having to disassemble the burner 100. The ignition electrodes 55 can also be used as ionization electrodes if the flame is monitored with an ionization current. If no ionization monitoring is used, the flame can be monitored optically and/or by means of direct measurement of the combustion quality using a CO or $O_2$ sensor.

The mixing device 10 comprises recirculation means 70 which are arranged axially fixed inside of the mixing device 10 and which can be used to change the passage cross-section 86 of the recirculation openings 85 by adjustment. The recirculation means 70 are particularly developed as an annular element with a peripheral wall 71, which in an alternative embodiment can comprise a base 72 to form a cup-shaped element in this way, which is open in the direction of the flame-tube 30, for example. In this case, the outside diameter of the peripheral wall 71 of the recirculation means 70 essentially corresponds to the inside diameter of the adapter ring 80, wherein a clearance is provided, if necessary, but where the adapter ring 80 generally serves as the guide tube for the recirculation means 70. In the base 72 of the recirculation means 70 a centric opening 73 is arranged, which is positioned upstream of the discharge opening 74 of the air nozzle 60 and the nozzle connection 40 with the fuel nozzle 42. The ignition electrodes 55 are run through two further openings of the base 72 of the recirculation means 70. The centric opening 73 of the base 72 of the recirculation means 70 can be developed as a discharge opening 74 in the form of a nozzle.

Openings 75 are arranged in the peripheral wall 71 of the recirculation means 70. Both the recirculation openings 85 as well as the openings 75 are developed as slots which are inclined particularly towards the longitudinal axis 1 of the mixing device 10, wherein the recirculation openings 85 and the openings 75 preferably correspond essentially in their form and inclination. The recirculation means 70 are axially fixed in that they abut on the end of the burner tube 20 facing the flame-tube 30 which is inserted overlapping inside on the adapter ring 80. The recirculation means 70 are preferably additionally axially fixed in that the centric opening 73 of the base 72 on the air nozzle 60 is arranged fixed to the discharge opening 63 of the air nozzle 60, for example. For this purpose, especially a flange 64 is arranged on the discharge opening 63 of the air nozzle 60 which is fixed on the base 72 of the recirculation means 70 by welding or by screwing, for example. The base 72 of the recirculation means 70 can particularly serve as a dividing wall against the heat between the burner tube 20 and the flame-tube 30. In addition, insulation can be arranged between the recirculation means 70 and the outside of the casing 110 of the burner 100 in order to reduce the heat load on the combustion chamber.

The recirculation means 70 are developed and arranged rotatably around their longitudinal axis inside of the mixing device 10, which in particular corresponds with the longitudinal axis 1 of the mixing device 10, in order to vary the passage cross-section 86 of the recirculation openings 85 during rotation around their longitudinal axis. This occurs particularly as a result that by rotating the recirculation means 70 around their longitudinal axis, the opening 75 are either arranged aligned with the recirculation openings 85 and therefore free the complete passage cross-section 86 of the recirculation openings 85 or during the further rotation of the peripheral wall 71 of the recirculation means 70 cover the recirculation openings 85 at least partially or completely and thus vary the passage cross-section 86 up to the complete closure of the recirculation openings 85.

Figure 6:
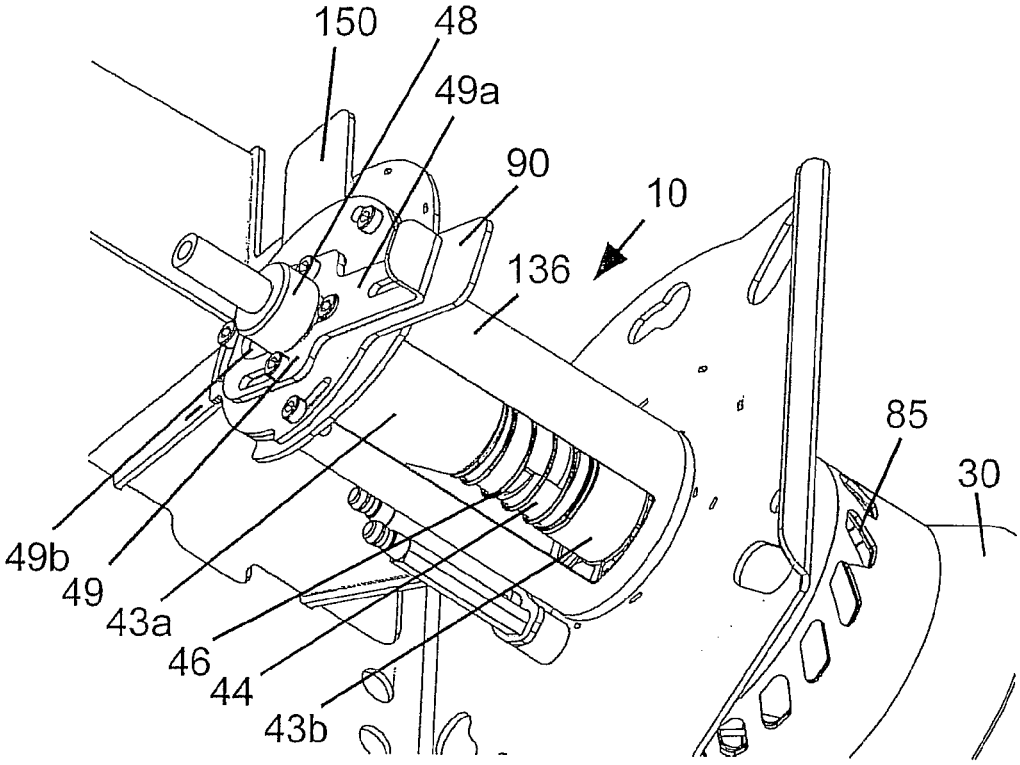
FIG. 6 is a perspective view of a claw coupling of a support of the mixing device according to FIG. 2.

The rotation of the recirculation means 70 occurs especially by means of an actuating element inside of the mixing device 10. Present here is the actuating element through the air nozzle, which is connected axially and torque-proof with the recirculation means 70 and is developed torque-proof on a support 43 arranged on the air nozzle 60 for the nozzle connection 40. The support 43 holds the nozzle connection 40 coaxially in the burner tube 20 and the air nozzle 60. The support 43 comprises especially a first element 43*a* and a second element 43*b*, which are connected torque-proof by means of a claw coupling 44 (see especially FIG. 6). The second element 43*b* here is arranged upstream of the separation disk 50, which is connected with the air nozzle 60, while the first element 43*a* is arranged upstream of the second element 43*b* and is connected upstream with an actuation plate 90, by means of which the support 43 is particularly attached in the casing 110 of the burner 100. The actuation plate 90 permits especially an airtight sealing of the casing 110 of the burner 100 and is preferably arranged pivoted in the casing 110.

When turning the actuation plate 90, therefore, the first element 43*a* of the support 43 is rotated by means of the claw coupling 44 and at the same time the second element 43*b* of the support 43 and above the separation disk 50 as well as the air nozzle 60 arranged on it including the recirculation means 70 arranged on the air nozzle 60, so that in this manner with the help of the actuation plate 90, the recirculation means 70 can be adjusted from outside of the burner 100, in order to be able to vary the passage cross-section 86 of the recirculation openings 85 during the operation of the burner 100.

The rotational travel of the actuation plate 90 is preferably limited by means of a slot 92 arranged in the actuation plate 90 which is developed as a curved segment, and a peg 93 guided in the slot 92, which is arranged torque-proof for example on the outside wall of the casing 110 limited, in order to adjust the positions uniquely so that they can be visible from the outside, in which the recirculation means 70 either completely open, or completely close, the recirculation openings 85. An adjustment of the actuation plate 90 can either occur manually or also automatically, especially automated with the help of a controller.

Between the first element 43*a* and the second element 43*b* of the support 43, a spring 45, in particular a coil spring 45, is arranged (see particularly FIG. 6), which is tensioned between appropriate peripheral projections on the first element 43*a* and the second element 43*b* and therefore causes the second element 43*b* including the separation disk 50 arranged on it to be pressed against the inside wall of the casing 110, so that with the help of the separation disk 50 and the seal 66 arranged on the inside wall of the casing 110, the opening 112 is sealed through which the air nozzle 60 of the mixing device 10 is run, occurs.

Figure 4:
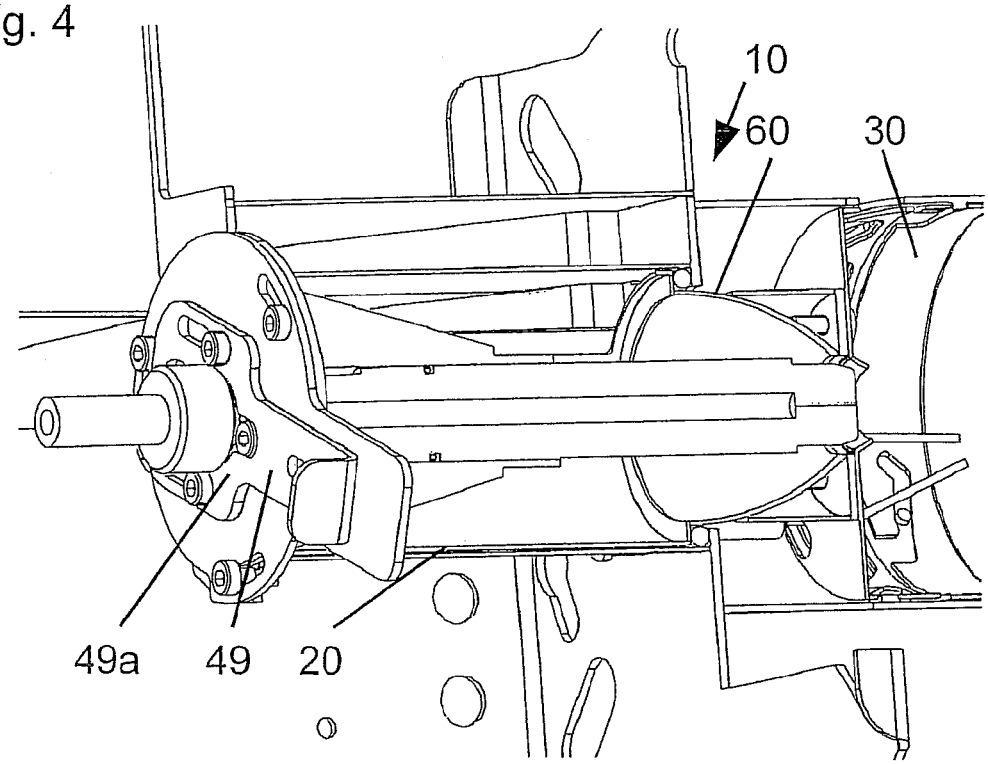
FIG. 4 is a partial section of a perspective view of a second embodiment of a mixing device.
Figure 5:
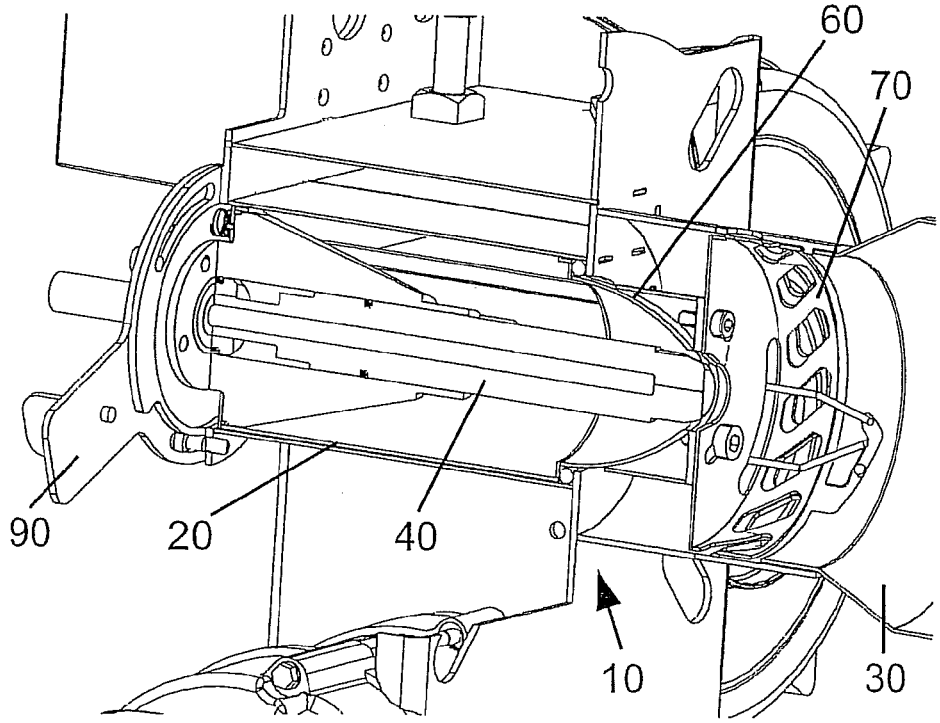
FIG. 5 is a partial section perspective view of the mixing device according to FIG. 4.

FIGS. 4 and 5 provide perspective, partial sectional views of the mixing device 10 according to FIGS. 1 to 3, where the air nozzle 60 on the side of the burner tube is not terminated by the separation disk 50. The sealing between the interior space of the burner tube 20 and the interior space of the flame-tube 30 preferably occurs through the base 72 of the recirculation means 70. The separation disk 50 can especially be dispensed with if the already swirled air is supplied into the burner tube 20.

Figure 7:
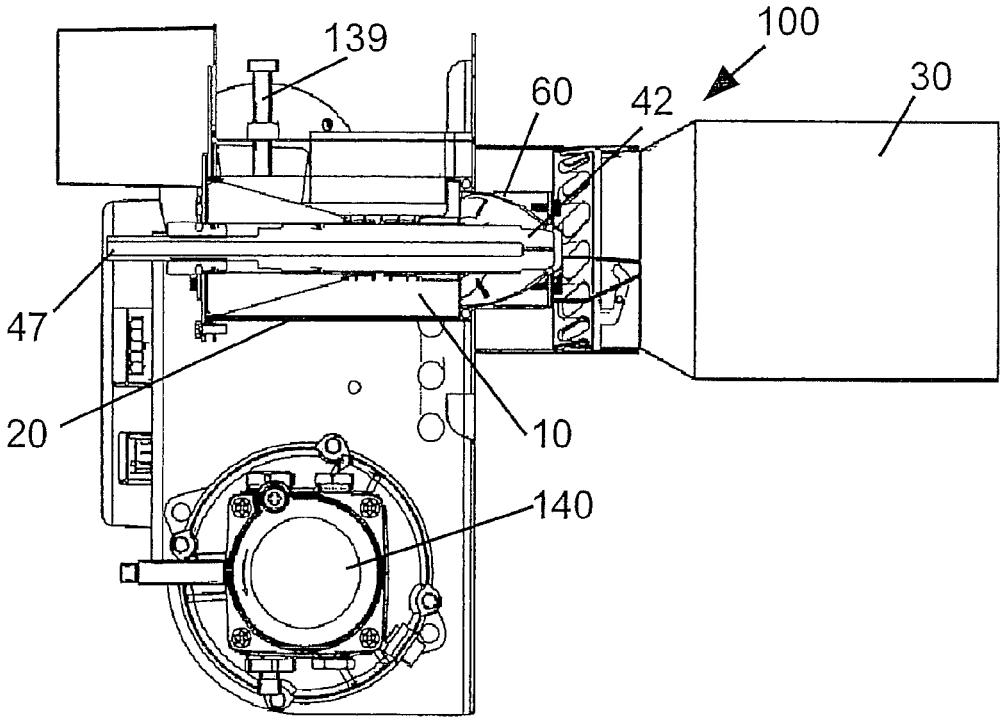
FIG. 7 is a partial section illustrating the components of a burner according to FIG. 1 with a nozzle connection shown in a first position.
Figure 8:
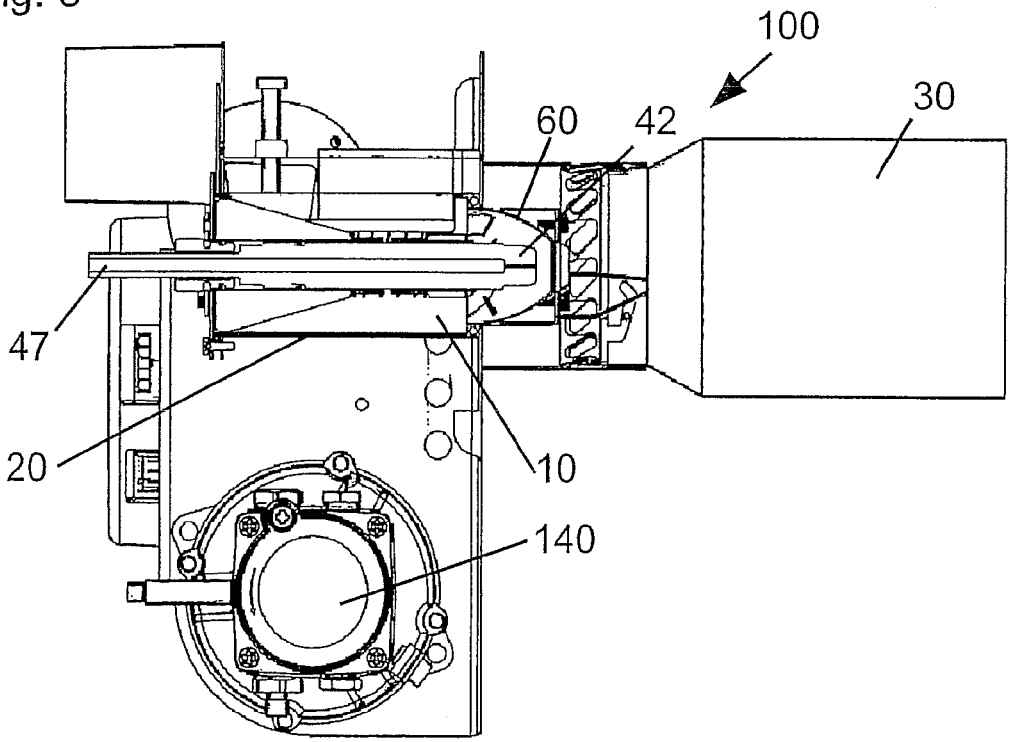
FIG. 8 is the illustration according to FIG. 7 with the nozzle connection in a second position.
Figure 9:
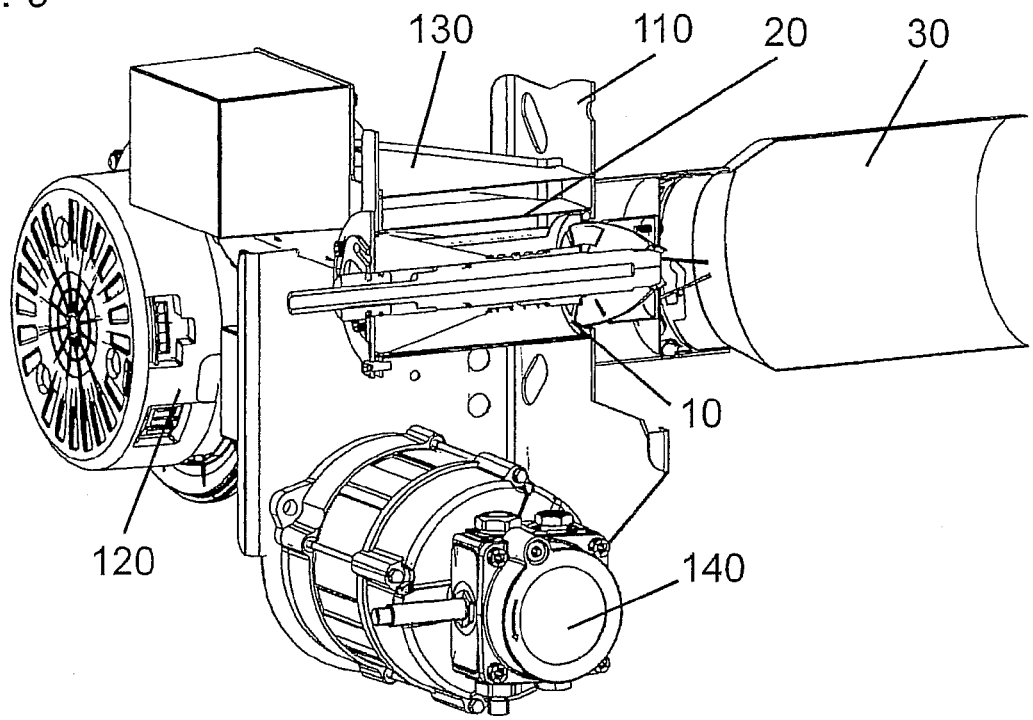
FIG. 9 is the burner according to FIG. 1 as a perspective illustration with a partially sectioned mixing device.
Figure 10:
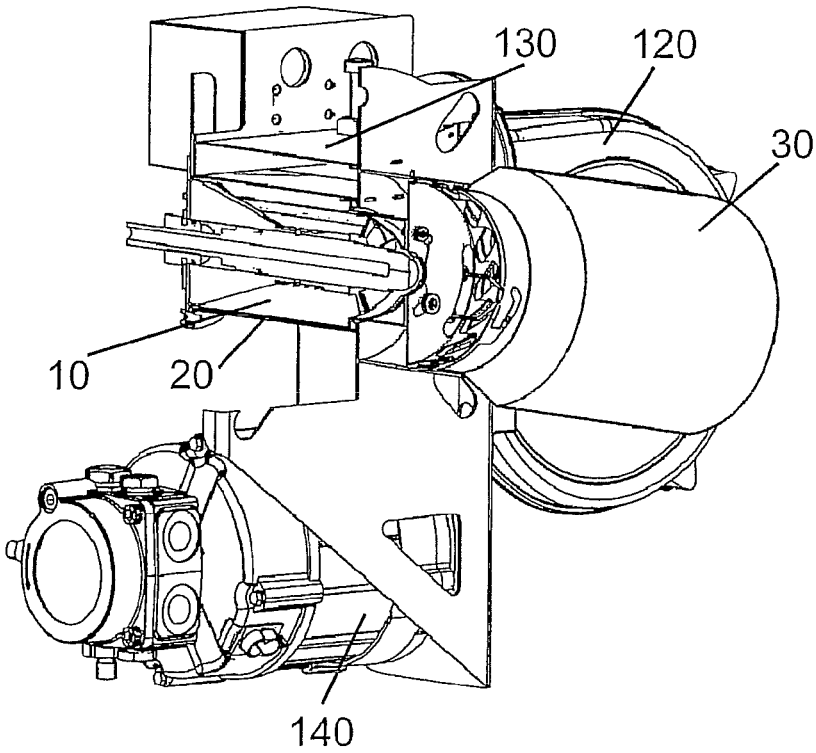
FIG. 10 is another perspective view with the partially sectioned mixing device according to FIG. 9.

FIGS. 7 to 10 show different views of the burner 100 with a mixing device 10 according to FIGS. 1 to 3, from which it can be seen that in one embodiment, the nozzle connection 40 including the fuel nozzle 42 is arranged axially shiftable in the mixing device 10. In this context especially, FIGS. 7, 9, and 10 show the nozzle connection 40 in a first position, in which the fuel nozzle 42 is positioned in the discharge opening 63 of the air nozzle 60, while FIG. 8 shows the position of the nozzle connection 40, in which the fuel nozzle 42 is positioned axially offset upstream of the discharge opening 63 of the air nozzle 60.

In order to be able to adjust the nozzle connection 40 axially, a spindle 47 is arranged on the upstream end of the nozzle connection 40, which is guided by an adjusting nut 48. When turning the adjusting nut 48, therefore, the spindle 47 and the nozzle connection 40 that follows, including the fuel nozzle 42, is either turned into or out of the mixing device 10, depending on the direction of rotation. Because the spindle 47 projects out of the upstream end of the burner tube from the housing 110 of the burner 100, it is especially possible that an axial movement of the nozzle connection 40 can also occur during the operation of the burner 100. The axial position of the nozzle connection 40 is steplessly adjustable by means of the adjusting nut 48.

Locking means can be provided, so that when the adjusting nut 48 is in the desired position, the adjusting nut 48 can be locked in order to prevent unintentional movement of the adjusting nut 48.

Figure 11:
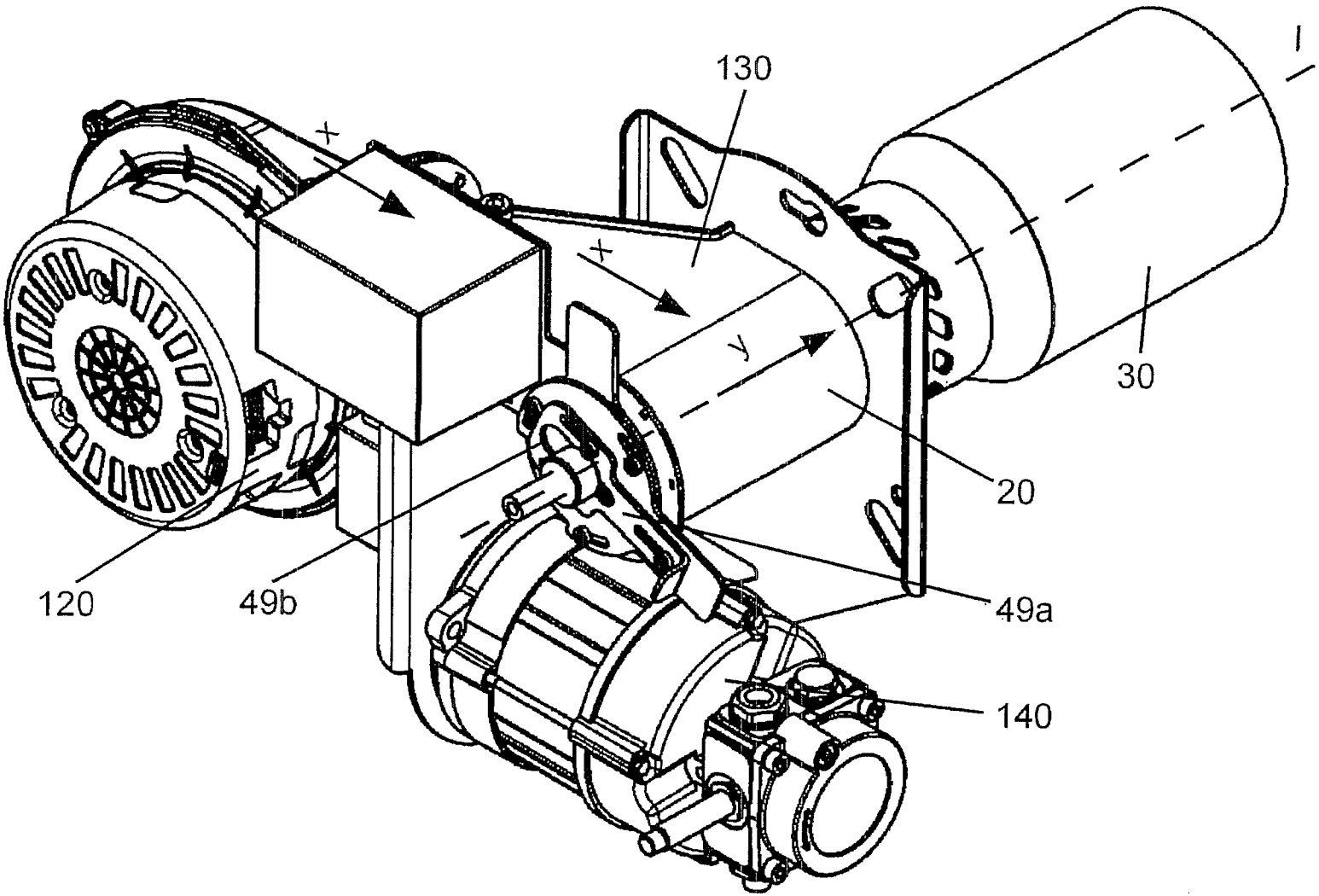
FIG. 11 is a perspective view of the components of the burner according to FIG. 1.
Figure 12:
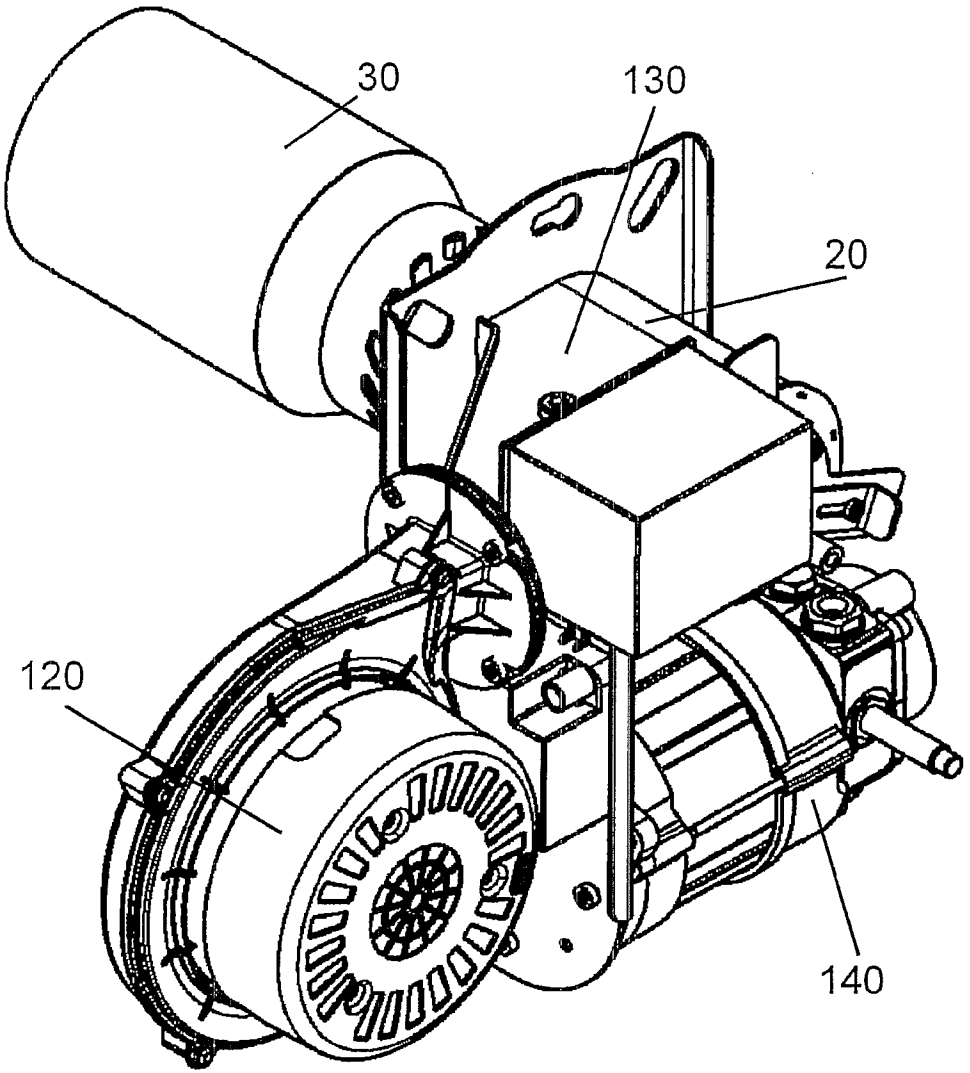
FIG. 12 is a further perspective illustration of the components of the burner according to FIG. 1
Figure 13:
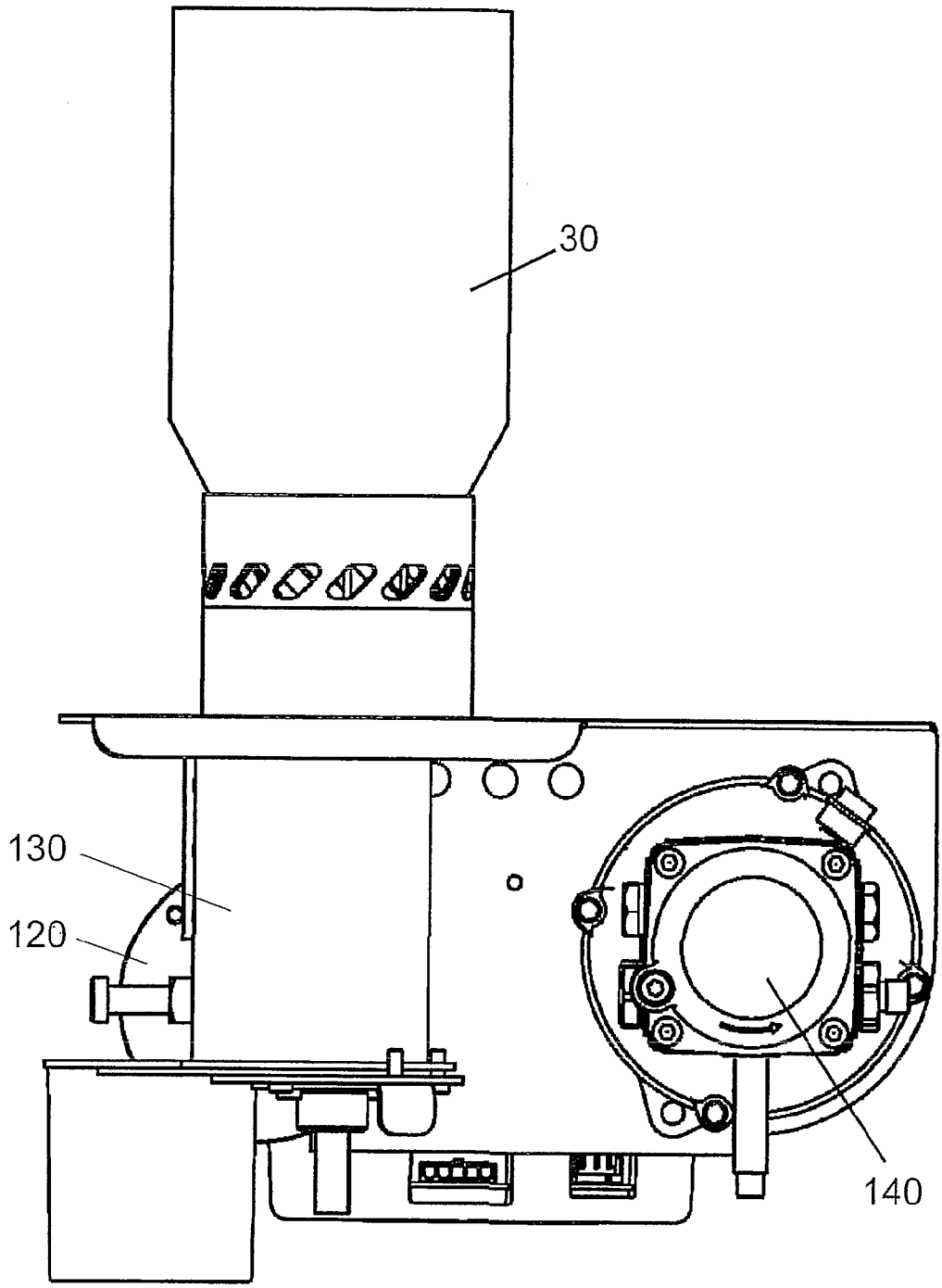
FIG. 13 is a side elevation of the components of the burner according to FIG. 1.
Figure 14:
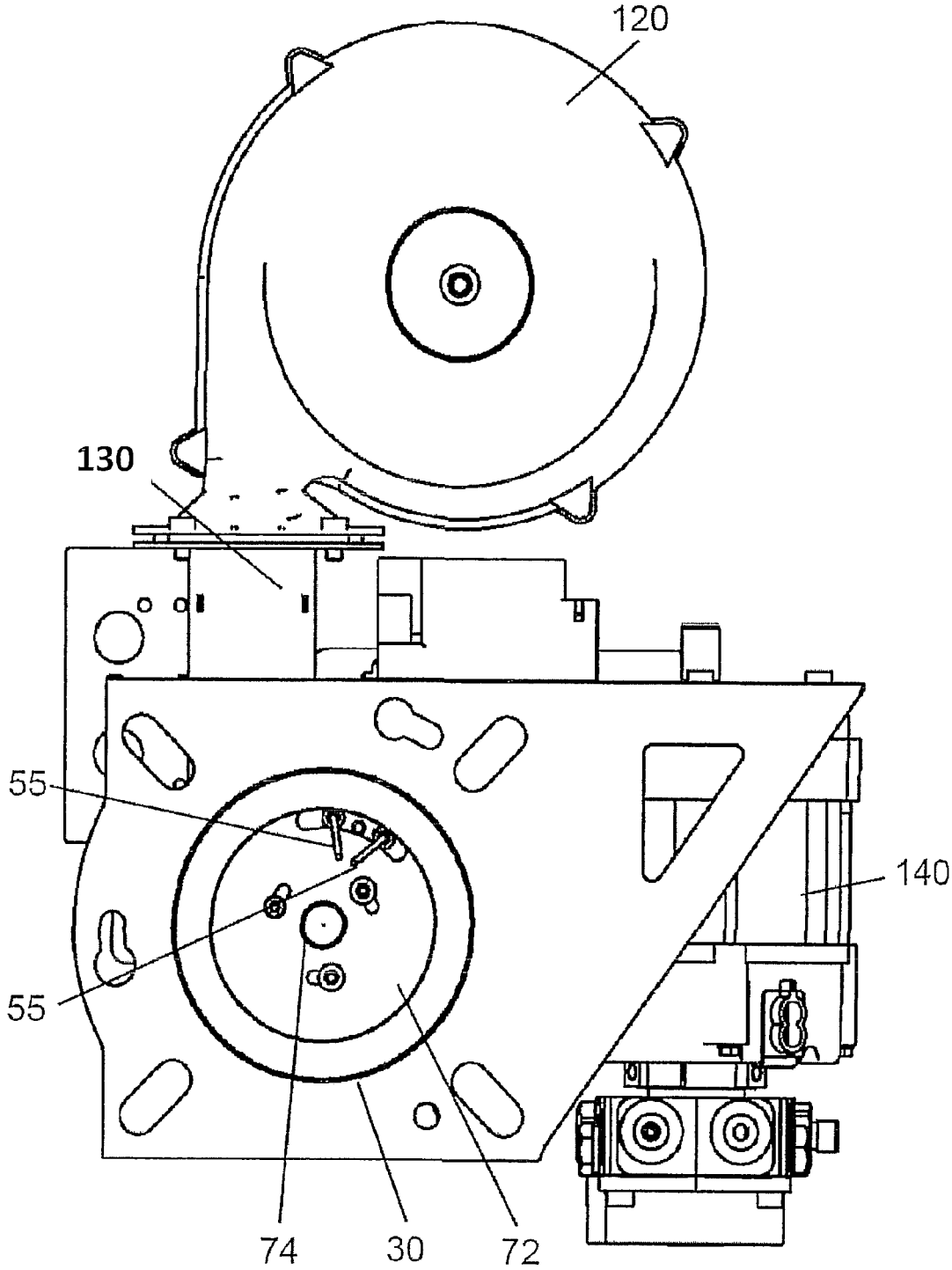
FIG. 14 is another side elevation of the components of the burner according to FIG. 1.
Figure 15:
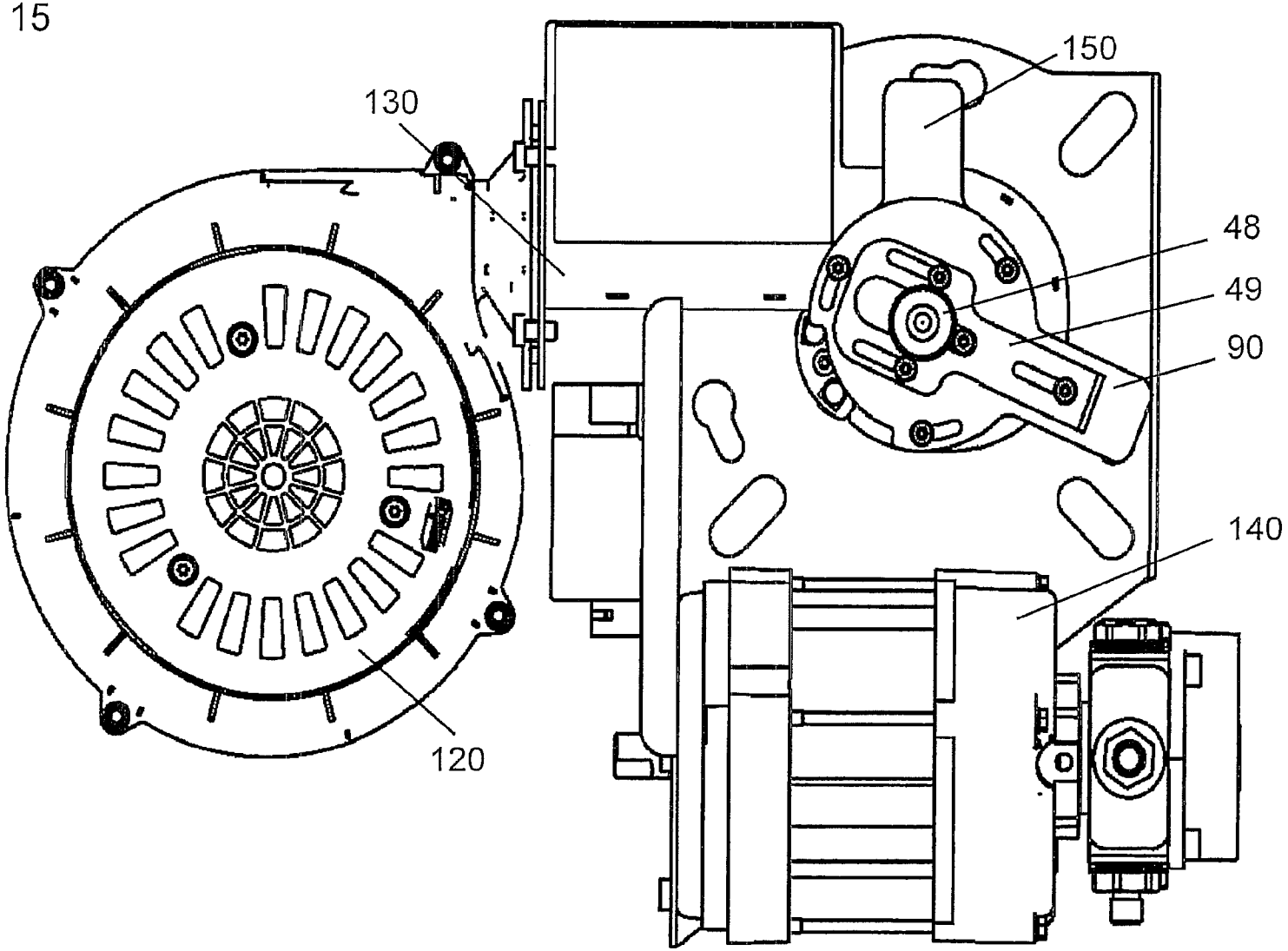
FIG. 15 is another side elevation of the components of the burner according to FIG. 1.

Furthermore, an interlocking device 49 can be provided so that an interlock is possible to lock the adjusting nut 48 in the axial direction to prevent that the spindle 47 is axially pulled out completely. When the interlocking device 49 is loosened, the spindle 47 including the nozzle connection 40 and the fuel nozzle 42 attached thereon can be pulled out axially from the mixing device 10, so that the fuel nozzle 42 can be easily replaced in this manner. In this context, the interlocking device 49 is particularly developed as a shiftable plate 49*a* arranged transverse to the longitudinal axis 1 of the mixing device 10, with a keyhole type opening 49*b* (see especially FIGS. 4, 6, and 11), so that during the engagement of the smaller part of the keyhole type opening 49*b*, the axial locking of the adjustment nut 48 and, when the adjusting nut 48 is engaged in the widened part of the keyhole type opening 49*b*, the adjusting nut 48 including the threads (not shown) and the nozzle connection 40 can be pulled out.

The nozzle connection 40 can in particular be axially shifted manually or automatically, especially if the automatic shift can be shifted by a controller.

FIGS. 11 to 15 show different components of the burner 100 with the mixing device 10, the blower 120, and a fuel pump 140.

Figure 16:
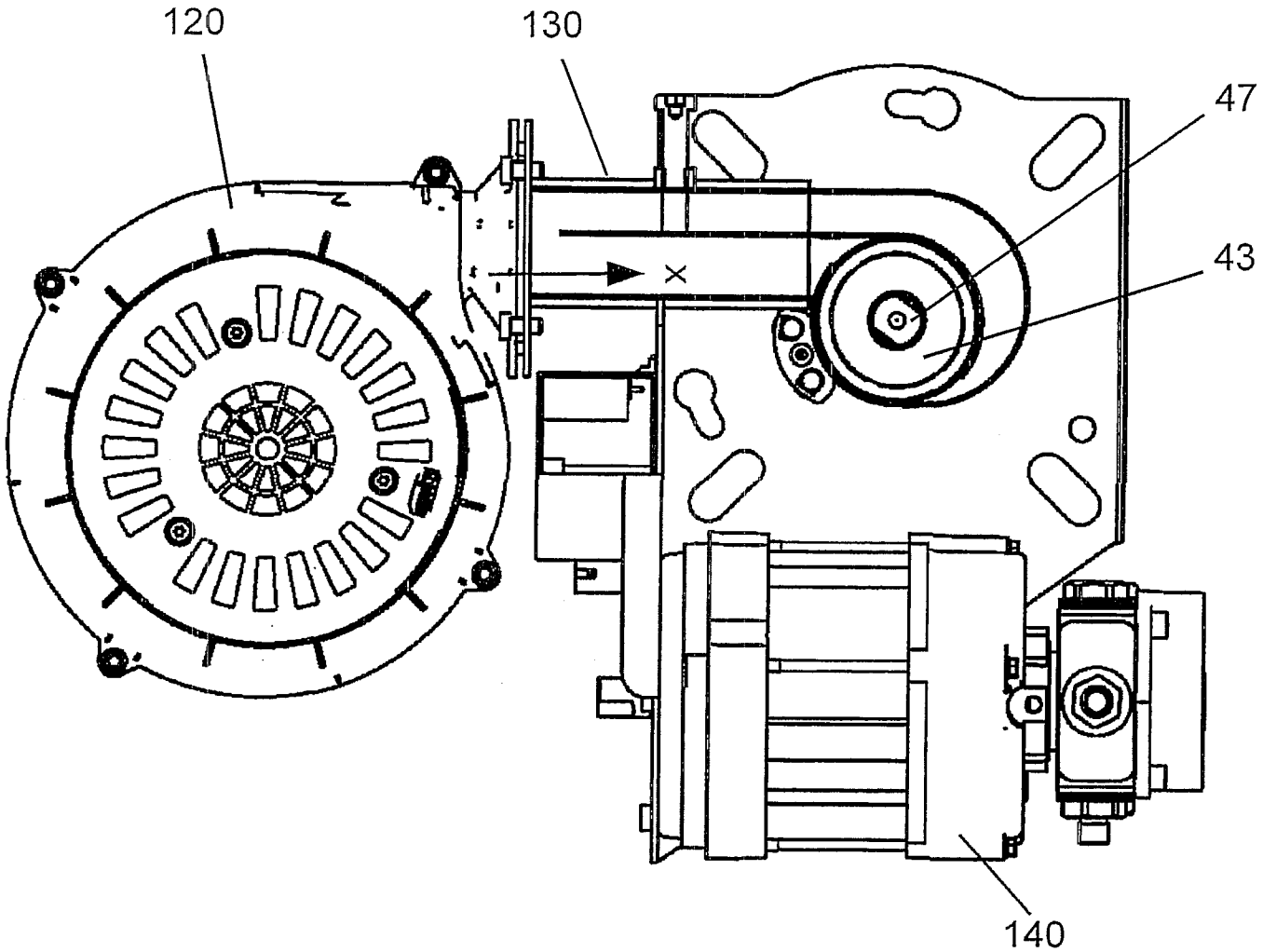
FIG. 16 is a side elevation according to FIG. 15 with a view into the connection duct between the blower and the mixing device.

The blower 120 generates airflow along a first direction x (see especially FIGS. 11 and 16), which is supplied into the burner tube 20 of the mixing device 10 by means of a connection duct 130. The embodiment of the connection duct 130 is explained in greater detail by means of FIGS. 16 to 18, which in principle is independent of the actual embodiment of the mixing device 10. The blower 120 generates an airflow in the first direction x, in which the air flows into the connection duct 130, wherein the connection duct 130 diverts the air into a second direction y, which especially runs perpendicular to the first direction x. The second direction y in particular corresponds to the longitudinal axis 1 of the mixing device 10, so that the connection duct 130 ensures that the air flows into the mixing device 10 in the direction of the longitudinal axis 1, but the blower 120 does not have to be arranged in the extension of the longitudinal axis 1, where the thermal load is high, but can be arranged offset to longitudinal axis 1, where the thermal load is less.

In the first direction x, the connection duct 130 expands wedge-shaped in order to already provide a velocity component in the second direction y.

The connection duct 130 is especially designed so that it comprises means which divert the air that inflows in the first direction x in a circular flow around the second direction y. In this manner, an intrinsic angular momentum of the airflow is already achieved in connection duct 130, which benefits the working method of the mixing device 10 to the extent that improved turbulence between the inflowing air and the injected fuel occurs, so that a more stable flame can be achieved in this manner.

The connection duct 130 comprises a tube section 132, the longitudinal axis of which runs parallel to second direction y and therefore parallel to longitudinal axis 1 of the mixing device 10 and which particularly, at least in sections, corresponds with the burner tube 20. The tube section 132 comprises at least one, presently two diametrically opposed inflow openings 134. The airflow along the first direction x can inflow tangentially into the tube section 132 through one of the two inflow openings 134. Air can likewise flow tangentially into the tube section 132 through the diametrically opposed inflow opening 134, but after being diverted by 180° from the first direction x. In this manner, with the help of the connection duct 130, air is directly supplied tangentially into the burner tube 20, wherein a circular flow is generated around the longitudinal axis 1 of the mixing device 10 and therefore already swirled air is supplied to the air nozzles 60 through the burner tube 20, so that the separation disk 50 with swirl openings 53 can be dispensed with, if necessary, or alternatively is further swirled through the swirl openings 53 of the separation disk 50 in the direction around the longitudinal axis 1 of the mixing device 10. The direction of the swirl openings 53 in this context corresponds in particular to the direction of the circular flow around the longitudinal axis 1 of the mixing device 10, in order to disturb the airflow as little as possible. Also the inclination of the recirculation opening 85 and the openings 75 of the recirculation means 70 correspond in particular to the directional swirl of the inflowing air, in order to disturb the airflow as little as possible.

The diversion of the air flowing out of blower 120 into the inflow opening 134 particularly occurs by means of an air deflector 138, with partitions the connection duct 130 into two air ducts, one of which diverts air to the first inflow opening 134 and the other diverts air by 180° into the second inflow opening 134, in order to be able to supply air in this manner through both inflow openings 134 into the tube section 132 tangentially. The position of the air deflector 138 inside the connection duct 130 can be adjusted by means of a bolt 139, for example, in order to be able to vary the air volume which flows through both inflow openings 134.

Furthermore, means are provided by means of which a passage cross-section 135 of the inflow openings 134 can be variably adjusted. The means are developed as tube 136 which with its outside wall bears against the inside wall of tube section 132 and/or the inside wall of the air deflector 138. The tube 136 comprises two diametrically arranged openings 137, which are particularly developed as slots in direction of the longitudinal axis 1 of the mixing device 10, where the tube 136 is arranged pivoted around the longitudinal axis 1, so that depending on the rotation and the position of the tube 136 and the openings 137 relative to the inflow openings 134, the inflow openings 134 can be opened more or less, thereby varying the passage cross-section 135 of the inflow openings 134. The rotation of the tube 136 occurs especially by means of an actuator 150 (see particularly FIG. 2), which can preferably be actuated from the outside of the burner casing, so that a variation of the passage cross-section of the inflow openings 134 can be done during the operation of burner 100. The actuator 150 comprises a slot 152 which guides a peg 153, which limits the rotational travel of the actuator 150, so that also without having to open the burner casing it can be seen whether the inflow openings 134 presently have a maximum or minimum passage cross-section or one which is in-between the two extreme positions.

The airflow in direction of the longitudinal axis one of the mixing device 10 benefits further from the fact that in tube section 132, particularly in the burner tube 20, a truncated cone is arranged, the tapered section of which faces in the direction of the mixing device 10 or the flame-tube 30, wherein presently the second element 43*b* and a support 43 of the nozzle connection 40 is developed as a truncated cone element.

Figure 17:
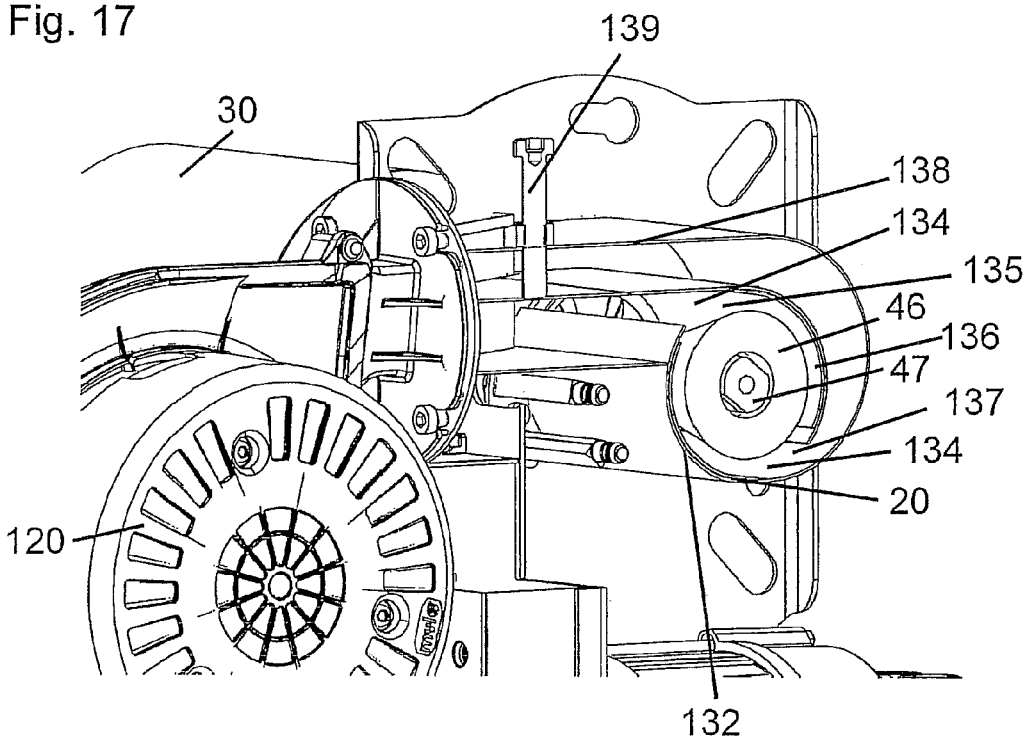
FIG. 17 is a partially sectioned illustration of the components of the burner with a view into the connection duct between the blower and the mixing device with a tube for varying the passage cross-section of inlet openings in a first position.
Figure 18:
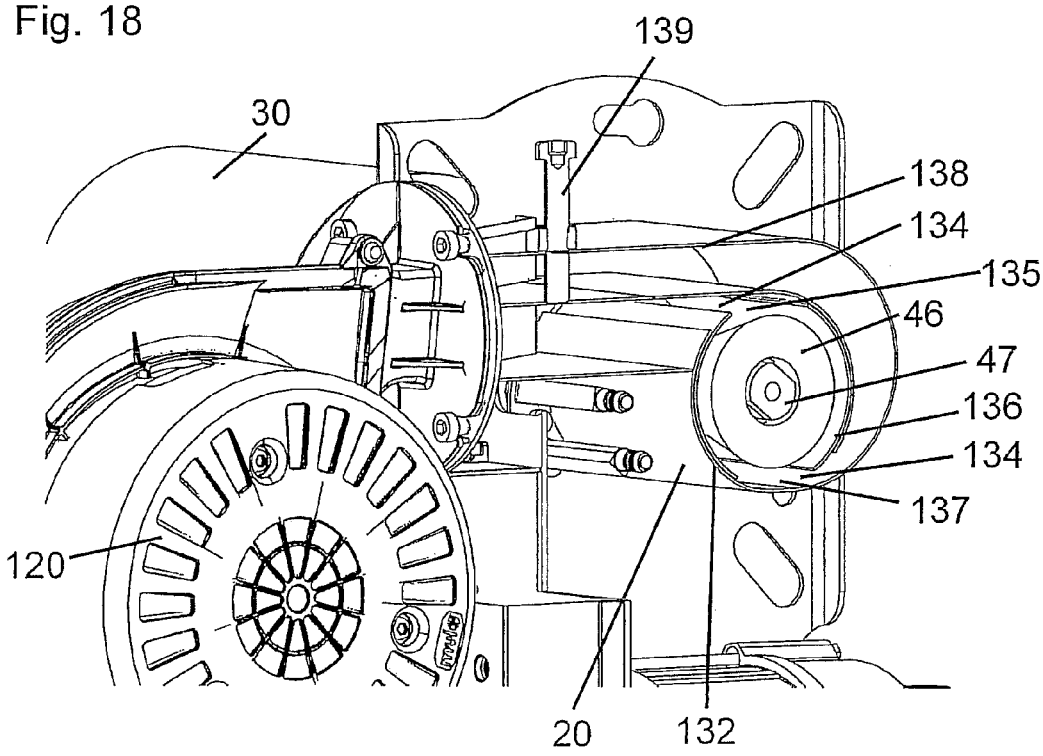
FIG. 18 is a partially sectioned illustration according to FIG. 17 with the tube for varying the passage cross-section of the inlet openings in a second position.
Figure 19:
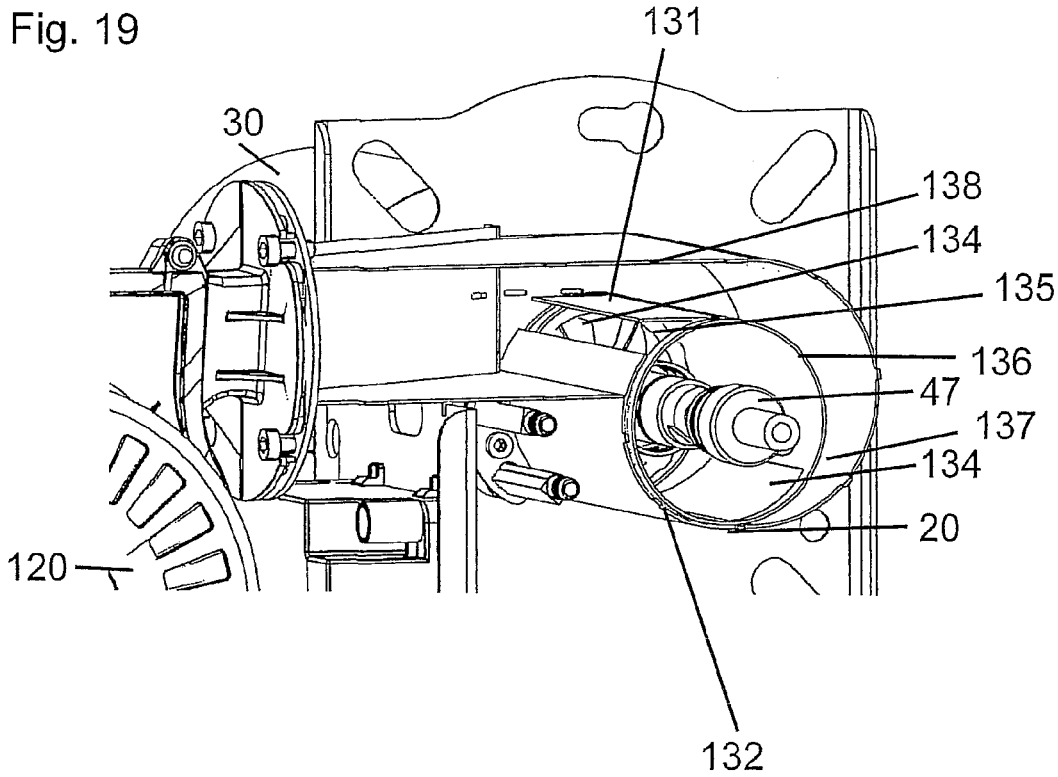
FIG. 19 is a partially sectioned illustration of the components of the burner with a view into the connection duct between the blower and the mixing device with a tube for varying the passage cross-section of inlet openings in a first position.
Figure 20:
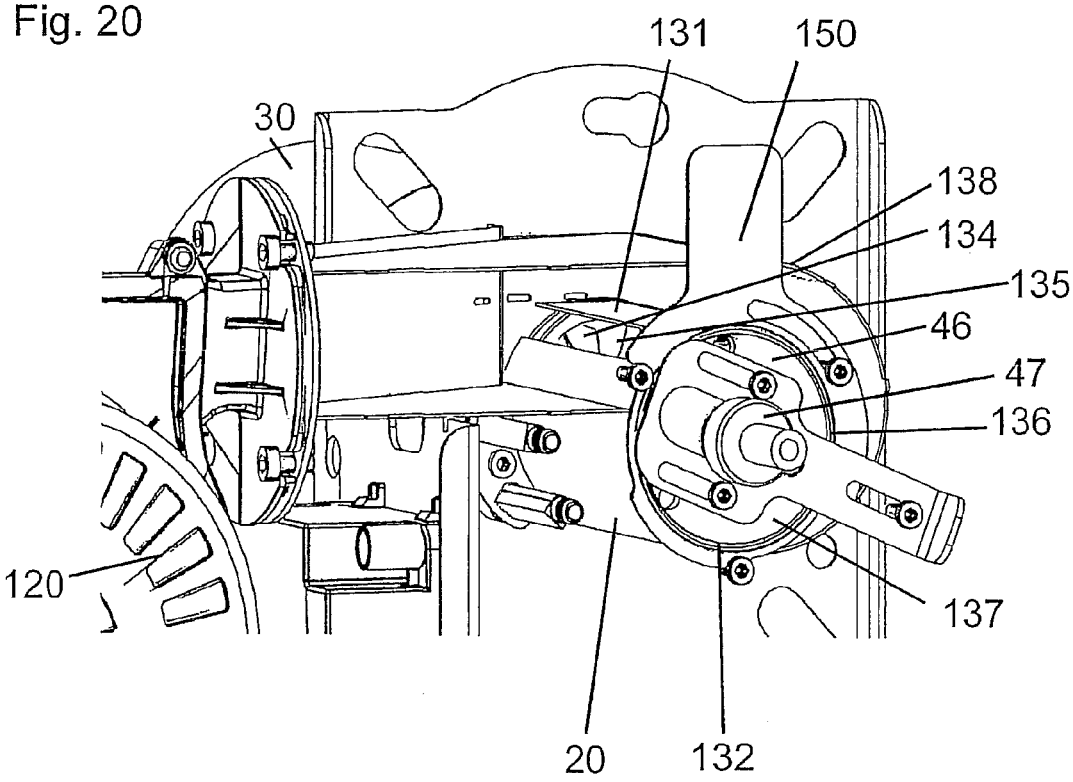
FIG. 20 is a partially sectioned illustration according to FIG. 19 with the tube for varying the passage cross-section of the inlet openings in a second position.

An alternative embodiment of the connection duct 130 in FIGS. 17 and 18 is shown in FIGS. 19 and 20. It is possible, as illustrated in FIGS. 19 and 20, that the air deflector 138 arranged in connection duct 130 can be omitted, so that the air flowing out of the blower 120 flows partially into the first inflow opening 134 and partially merely on the outside of the burner tube 20, diverted into the diametrically opposed inflow opening 134. In place of the air deflector 138, a deflector 131 can be tangentially arranged on the tube 136, particularly on one of the openings 137, which particularly extends through the first inflow opening 134 into the connection duct 130 and favors a partitioning of the airflow. For this purpose, the deflector 131 is also turned when tube 136 turns, so that a variation of the passage cross-section of the inflow opening 134 can also occur in this manner.

In all illustrated embodiments, the speed of the blower 120 can preferably be steplessly controlled in a smooth manner (without steps). Furthermore, the quantity of the fuel which is supplied via the fuel nozzle 42 to the mixing device 10, can also be steplessly controlled in a smooth manner (without steps).

The burner 100 for the mixing device 10, the blower 110 and the connection duct 130 that is arranged therebetween, permits low-pollution, efficient combustion of liquid or gaseous fuels. Because of the described geometry of the connection duct 130, the pressure loss of the inflowing combustion air is minimized and the blower pressure is primarily used for mixing of combustion air and fuel and to overcome the resistance on the exhaust gas side in the heat generator and in the exhaust system. Because of the geometry in the connection duct 130, an increase of the static pressure of the expansion of the cross-section in the air ducts in the junction to the burner to 20 is produced, which stabilizes the flame even during pressure fluctuations in the exhaust gas system. Because of the swirling of the air already in the burner tube 20, this creates a high angular momentum other combustion air which permits the homogenous swirling of the fuel/air mixture ahead of and after the air nozzle 60 with or without separation disc 50 and a stable low pressure zone in the recirculation area. The homogenous swirling and the optimally inflowing exhaust gases permit optimum mixing of the combustion air, the controlling hot exhaust gases, and the injected, cone-shaped, gaseous suspension fuel spray, which is optimally vaporized ahead of the root of the flame. Stable combustion occurs with a particularly low noise level in the presence of a blue flame with low NOx, CO, and CxHy emissions. This also prevents undesirable, spontaneous backfiring in the area of the root of the flame and along the recirculation zone. In this way, particularly the formation of soot on the mixing head and on the ignition electrodes 55 is prevented. The good mixing of combustion air, exhaust gases, and fuel permits a reduction in the injection pressure to less than 4 bar, particularly for heating oil. This permits a reduction of the burner output to below 7 kW, if normal commercial fuel nozzles 42 are used. By reducing the pressure losses in burner 100, the system is also suitable for use in high output ranges of more than 150 kW, where previously the exponentially increasing blower output limited the use of blue flame systems with a swirl-stabilized flame. The optimally stabilized flame makes this system particularly suitable for the use of calorific value heat exchangers and boilers with high resistance on the exhaust gas side. The sealing of the air nozzle 60 to the flame-tube 30 and the combustion chamber prevents undesirable, non-defined, incorrect airflow. The resulting conditional soot formation and undesirable pressure loss are prevented.

The present burner 100 therefore particularly comprises a casing geometry, which by the appropriate manipulation of the combustion air can already place it into rotation through this tangential inflow into the combustion tube 20 already ahead of the air nozzle 60. The recirculating exhaust gases are moreover supplied by means of the inclined recirculation openings 85 arranged in the direction of the swirl into the combustion zone. The fuel nozzle 42 can be axially shifted to the stationary air nozzle 60, as a result of which the developing air outlet flow cross-section is variable. The velocity of the outflowing air, the air volume, and the air pressure, can therefore be varied. In connection with a speed-controlled blower 120, the required air volume for combustion, the air velocity, and the air pressure can be adapted pursuant to a characteristic curve. If the fuel quantity is also varied, by means of a modulating fuel pump 140 or a modulating fuel valve, for example, a modulating combustion method is possible in addition to single or multistage operation.

In the claims, means or step-plus-function clauses are intended to cover the structures described or suggested herein as performing the recited function and not only structural equivalents but also equivalent structures. Thus, for example, although a nail, a screw, and a bolt may not be structural equivalents in that a nail relies on friction between a wooden part and a cylindrical surface, a screw's helical surface positively engages the wooden part, and a bolt's head and nut compress opposite sides of a wooden part, in the environment of fastening wooden parts, a nail, a screw, and a bolt may be readily understood by those skilled in the art as equivalent structures.

Having described at least one of the preferred embodiments of the present invention with reference to the accompanying drawings, it is to be understood that the invention is not limited to those precise embodiments, and that various changes, modifications, and adaptations may be effected therein by one skilled in the art without departing from the scope or spirit of the invention as defined in the appended claims.

What is claimed is:

1. A connection duct between a blower of a burner and a mixing device of said burner, said connection duct for diverting outflowing air from said blower in a first direction into a second direction, and wherein said connection duct further comprises diverting means for diverting said air in a circular flow around said second direction; said diverting means are developed as a tube section, said tube section further comprising:

(a) a first inflow opening; and (b) a second inflow opening, wherein said first inflow opening and said second inflow opening are:

(i) diametrically opposed; and (ii) arranged in the peripheral wall of said diverting means and a longitudinal axis, wherein said longitudinal axis runs parallel to said second direction and said air from said first direction flows tangentially through said first and said second inflow openings into said tube section, wherein between said blower and said tube section, approximately parallel to said first direction, an air deflector is arranged such that a part of the inflow air is diverted into said tube section by means of said air deflector through said diametrically opposed inflow openings;

wherein said air deflector inside said connection duct is arranged for variable configuration.

2. A connection duct according to claim 1, wherein a truncated cone having a tapered section is arranged in said tube section so that said tapered section extends in the downstream direction of said mixing device.

3. A connection duct according to claim 1, wherein said mixing device comprises a burner tube formed from said tube section.

4. A connection duct according to claim 1, wherein the speed of said blower is steplessly variable.

5. A connection duct according to claim 1, wherein said mixing device comprises a nozzle connection further comprising a fuel nozzle, through which fuel is supplied, and wherein the quantity of said fuel is steplessly variable.

* * * * *